US005975866A

United States Patent [19]

Fisher et al.

[11] Patent Number: 5,975,866

[45] Date of Patent: Nov. 2, 1999

[54] TIE-OFF MEMBER FOR PEDESTAL SUMP PUMPS

[75] Inventors: Lynn E. Fisher; James V. Yu, both of Fort Wayne, Ind.

[73] Assignee: General Electric Company, Schnectady, N.Y.

[21] Appl. No.: 08/943,257

[22] Filed: Oct. 3, 1997

[51] Int. Cl.[6] ..... F04B 17/02

[52] U.S. Cl. ..... 417/423.3; 417/423.15; 417/360

[58] Field of Search ..... 417/423.3, 423.15, 417/63, 360

[56] References Cited

U.S. PATENT DOCUMENTS

| | | | |
|---|---|---|---|
| 2,662,206 | 12/1953 | Schaefer | 417/423.3 |
| 2,932,750 | 4/1960 | Eisenhart | 417/423.3 |
| 3,134,333 | 5/1964 | Nielsen | 417/423.3 |
| 3,255,702 | 6/1966 | Gehrm | 417/423.15 |
| 3,319,572 | 5/1967 | Schaefer | 417/423.3 |
| 3,472,168 | 10/1969 | Mitsuo Inque et al. | 417/423.3 |
| 3,502,029 | 3/1970 | Halladay | 417/423.15 |
| 3,685,926 | 8/1972 | Blum | 417/424 |
| 3,748,066 | 7/1973 | Sully et al. | 417/424 |
| 3,837,767 | 9/1974 | Aller | 417/424 |
| 3,932,853 | 1/1976 | Cannon | 340/244 |
| 4,308,000 | 12/1981 | Oakes | 417/360 |
| 4,726,742 | 2/1988 | Harbison et al. | 417/360 |
| 5,076,762 | 12/1991 | Lykes et al. | 417/40 |
| 5,137,433 | 8/1992 | Willinger et al. | 417/312 |
| 5,181,841 | 1/1993 | Kirkland | 417/423.3 |
| 5,207,562 | 5/1993 | Neilbrook et al. | 417/234 |
| 5,380,158 | 1/1995 | Gerbitz | 417/40 |
| 5,462,415 | 10/1995 | Chen | 417/360 |
| 5,511,957 | 4/1996 | Tuckey et al. | 417/313 |

*Primary Examiner*—Charles G. Freay
*Assistant Examiner*—Robert Z. Evora
*Attorney, Agent, or Firm*—Welsh & Katz, Ltd.; Wayne O. Traynham, Esq.; Carl B. Horton, Esq.

[57] ABSTRACT

A mounting and handling shroud for a pedestal-type sump pump includes a cup-shaped member mounted to the sump pump motor. The cup shaped member has an end shroud plate contiguous with an outer shroud plate extending along at least a portion of the motor housing, generally perpendicular to the end shroud plate. The mounting member includes at least one mounting element formed therein that defines an opening for securing the motor to the sump. The mounting element includes a handle portion extending generally transversely relative to the outer shroud plate and a depending leg portion that defines a handle. The shroud can include a pump start switch, pump power and running indicators and a power cord strain relief device.

8 Claims, 1 Drawing Sheet

TIE-OFF MEMBER FOR PEDESTAL SUMP PUMPS

FIELD OF THE INVENTION

The present invention relates to a securing member for a pedestal-type sump pump. More particularly, the invention relates to a securing tie-off member for a pedestal-type sump pump motor that incorporates functional components.

BACKGROUND OF THE INVENTION

Sump pumps are in widespread use in most every residential and commercial structure. There are two common types of sump pumps. One known type of sump pump is commonly referred to as a submersible-type pump. In a submersible-type pump arrangement, the pump, including the motor, is positioned in a sump such that the entire assembly may be subject to immersion in the liquid in the sump. That is, the pump and motor may be positioned below the operating liquid level of the sump.

A pedestal-type pump, on the other hand, is configured such that the liquid-handling pump portion of the assembly rests in a sump below or at a normal liquid operating level. The motor portion of the pump assembly is mounted in spaced relation to the pump portion, and is typically above the normal operating water level. In this manner, the pump motor is generally not subject to immersion into the liquid in the sump.

Those skilled in the art will recognize that because the pump motor has considerable mass, pedestal-type sump pumps can be rather unstable when positioned in the sump. In an effort to increase the stability of such pumps, a variety of sump pump mounting arrangements have been developed. In one known mounting arrangement, the pump body is bolted or otherwise fixedly secured to the floor of the sump. Although this is an effective manner in which to secure the pump to the sump base, there still exists the instability associated with a large mass, i.e., the pump motor, that is positioned in spaced relation to (e.g., above) the fixedly mounted pump body. As such, the pump motor can produce a cantilever effect along the pump shaft, which in turn can adversely affect the performance and the life of the pump. Moreover, in such an arrangement, the pump can tip within the sump. This can result in binding of the pump float switch and consequent overflow of the sump.

Another known mounting method includes angled-type clamps that are affixed to upright portions of the pump and fixedly mounted to surfaces adjacent to the top of the sump. While this manner of securing the sump pump has proven effective in securing the pump, it has a number of drawbacks. First, because the clamps are fixedly mounted to both the pump motor and to adjacent surfaces there is no stress relief which may be necessary due to vibration or otherwise shifting of the pump. Second, the fixed mounting configuration increases the time necessary to remove the pump from the sump in the event that the pump requires maintenance or replacement.

In another type of mounting arrangement, the sump pump is mounted to a sump cover that extends over the top of the sump. This mounting method suffers from some of the same drawbacks as the angled clamp mounting configuration. That is, in order to access the pump for maintenance or removal, it may be necessary to manipulate the pump and/or the sump cover, which can be cumbersome and time consuming. Moreover, this mounting configuration also suffers from the rigidity problems associated with the angled clamp mounting configuration in that stress relief may not be provided for vibration or shifting of the pump.

In yet another known mounting configuration, the pump is fitted with an uppermost plate that envelopes the pump motor shaft and discharge piping. The plate includes a number of eye hooks to which cables can be connected to lift the pump and/or secure the pump in place. While this is an effective method for handling and mounting the pump, the additional weight of the upper plate can cause the pump assembly to become unstable and can increase the cantilever effect at the upper portion of the pump.

Accordingly, there continues to be a need for a sump pump mounting configuration that facilitates securing the pump to the sump, and provides for ease of handling of the pump. Such a mounting configuration includes provisions for alarms such as high water alarms, switches for pump initiation and termination, motor starting switches, pump cord strain relief devices and the like.

SUMMARY OF THE INVENTION

A mounting and handling shroud is used with a pedestal-type sump pump. The sump pump includes a base portion housing a pump impeller and a motor enclosed within a housing. The housing has upper and lower end walls and an outer wall. The motor is operably connected, in spaced relation, to the pump impeller by a shaft. The shroud includes a cup-shaped member having an end shroud plate contiguous with an outer shroud plate extending in a generally perpendicular orientation to the end plate. The outer shroud plate defines a generally circular configuration.

The cup-shaped member surrounds at least one of the upper and lower end walls and at least a portion of the outer wall. In one preferred configuration, the end shroud plate lies adjacent to the lower end wall of the motor housing, and includes an opening therein for receiving the pump shaft. In another preferred embodiment, the end shroud plate is an upper end shroud plate that lies adjacent to the upper end wall of the motor housing.

The shroud includes at least one mounting member formed therein. The mounting member includes an opening therein for receiving an associated securing element, such as a cable, rope or chain, for mounting the sump pump to the side of an associated sump. The mounting member includes a handle having a first projecting portion extending from the shroud outer plate in a direction generally perpendicular thereto and a leg portion contiguous with the first projection that extends generally parallel to and spaced from the outer shroud plate.

Advantageously, the present mounting and handling shroud facilitates securing the pump to the sump sides and provides for ease of handling of the pump. The present configuration permits ready maintenance of the pump and replacement thereof if necessary. Integrally mounted switches and alarms provide a single, unitary assembly by which all of the pump operational and monitoring requirements can be met. In addition, the present arrangement permits the pump to accommodate slight movement necessary as a result of vibration and the like, to reduce the stresses on interconnecting piping.

Other features and advantages of the present invention will be apparent from the following detailed description, the accompanying drawings, and the appended claims.

DETAILED DESCRIPTION OF THE INVENTION

Figure 1:
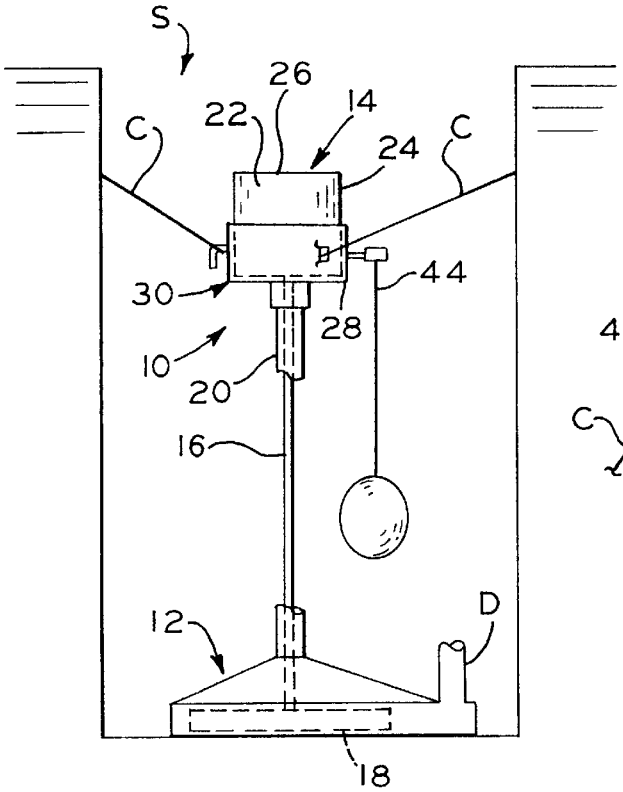
FIG. 1 is a side elevational view of an exemplary pedestal-type sump pump, shown positioned in a sump, illustrating one embodiment of a mounting shroud in accordance with the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a pedestal-type sump pump generally illustrated at 10. The pump 10 includes a pump base portion 12 and a motor 14 positioned above and in spaced relation to the base portion 12. In a typical configuration the base portion 12 rests on the floor of an associated sump S, and may be mounted or otherwise fixedly secured thereto. A motor shaft 16 extends between the motor 14 and the pump base portion 12, and is connected to a pump impeller 18 which is positioned in the base portion 12. In a typical arrangement, a shaft sleeve 20 extends between the motor and the base portion, surrounding or enveloping the pump shaft 16. The sleeve 20 provides structural rigidity to the pump 10, and provides personnel protection from the rotating shaft 16.

In a typical arrangement, a discharge pipe or discharge line D extends upward from the pump base 12 and is routed out of the sump to a discharge line, such as a sewage line.

Those skilled in the art will recognize that while portions of such pump assemblies 10 can be formed of relatively light weight material such as plastic, the pump motor 14 represents a large portion of the weight of the pump assembly 10 because it is typically manufactured from a majority of metal components. As such, a relatively large proportion of the weight of the pump 10 is spaced from the stable base portion 12.

The motor 14 includes a housing 42 having an outer wall 24 and upper and lower walls 24 and 26, respectively. A mounting shroud 30 is mounted or affixed to the housing 22. The shroud 30 is an element separate from and mounted to the motor housing 22. The shroud 30 is positioned on or connected to the motor 14 during assembly of the pump 10. The shroud 30 includes at least one, and preferably a plurality of mounting elements 32, 32*a* from which connectors C, such as cables can extend between the shroud 30 and the sides of the sump S. In a preferred embodiment, the shroud 30 is formed of a plastic material and the mounting elements 32 are formed integral with the plastic shroud 30. The elements 32 can be formed as integral, outwardly extending projections 34 having bores or openings 36 formed thereon.

Figure 2:
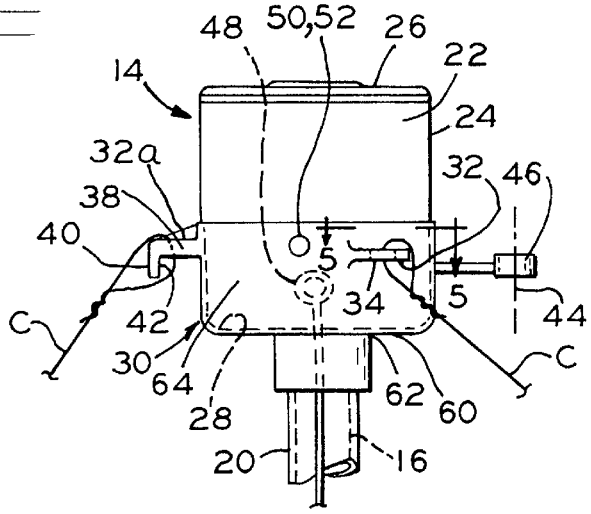
FIG. 2 is a partial side view of the pump of FIG. 1, illustrating the pump motor and the shroud mounted thereto.
Figure 3:
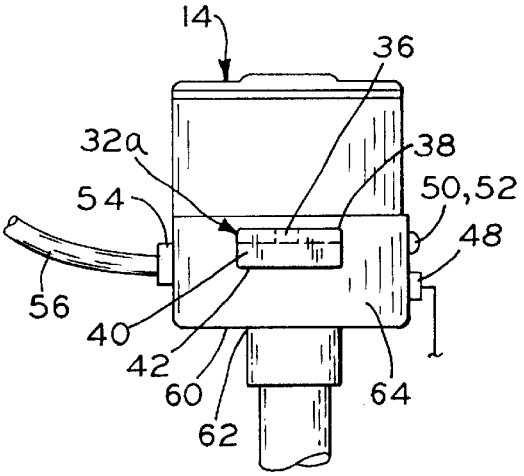
FIG. 3 is a partial side view of the motor and shroud of FIG. 2, as viewed from the left-hand side of FIG. 2.

At least one 32*a* of the mounting elements 32 is formed having an angled configuration, as shown in FIGS. 2–3. The angled configuration includes a base portion 38 that extends outwardly, radially from the motor 44 that is contiguous with a downwardly extending portion or leg 40. The outwardly extending base portion 38, contiguous with the leg portion 40 defines a hand grip or a handle 42 that provides for readily manipulating the pump 10, such as for positioning the pump 10 in or removing the pump 10 from the sump S.

In a most preferred embodiment, the shroud 30 includes various indicators, switches and alarms. Contemplated switches include a float switch 44, for on-off control of the pump 10, and a motor starting switch 46. A high water alarm 48 can also be incorporated into the shroud 30. Indicators, such as a power indicator 50 and a pump running indicator 52 can also be incorporated into the shroud 30. It is further contemplated that a power cord strain relief device 54 can be incorporated into the shroud 30. Such a device 54 clamps the power cord 56 at its exit from the shroud 30 and prevents straining the connections from the power cord 56 to the pump motor 14 in the event of shifting or vibration of the pump 10.

As best seen in FIGS. 2–3, the shroud 30 can be configured having a cup-like shape, that is adapted to fit to the bottom of the pump motor 14. The bottom mount configuration includes a lower shroud plate 60 having an opening 62 therein for passage of the motor shaft 16 and sleeve 20 therethrough.

The lower shroud plate 60 is contiguous with an upwardly extending outer shroud plate 64. The outer shroud plate 64 surrounds or envelopes at least a portion of the lower portion of the motor outer wall 24 and lower end wall 28. The mounting elements 32 extend outwardly, preferably from the outer shroud plate 64. In a most preferred configuration, the alarms 48, switches 44, 46 and strain relief device 54 are formed in the outer shroud plate 64. It will, however, be recognized by those skilled in the art that the switches 44, 46, alarms 48 and strain relief device 54 can be formed in the lower shroud plate 60 or at about a juncture of the lower and outer shroud plates 60, 64, respectively.

Figure 4:
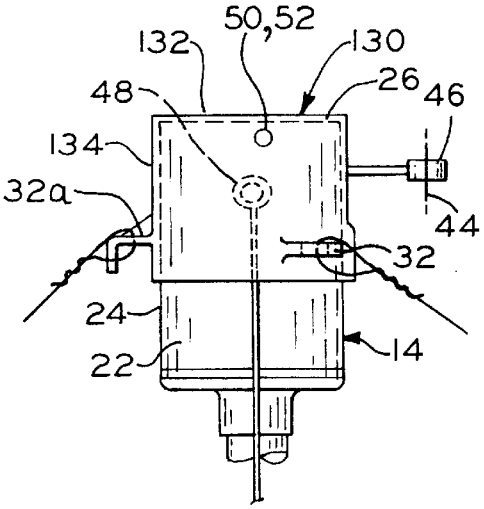
FIG. 4 is a view similar to FIG. 2 illustrating an alternate embodiment of the mounting shroud positioned on the upper portion of the pump motor.
Figure 5:
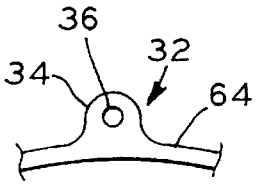
FIG. 5 is a view of an exemplary mounting member taken along line 5—5 of FIG. 2.

An alternate embodiment, that includes a top mounted shroud 130 is shown in FIG. 4. The top mount configuration includes all of the features of the bottom mount design 30. In the top mount configuration, the cup-shaped shroud 130 fits over the upper portion of the motor outer wall and the upper end wall 26 of the motor 14. The top mount shroud 130 includes an upper shroud plate 132 that is contiguous with a downwardly extending, depending outer shroud plate 134. The outer shroud plate 134 extends downwardly at least over a portion of the motor housing 22.

It will be appreciated by those skilled in the art, that the top mount configuration 130 precludes the need for an opening in the upper shroud plate 132 in that the motor shaft 16 does not extend therethrough.

The mounting elements 32 extend from the top mount shroud 130, preferably from the outer shroud plate 134. Alternatively, the mounting elements 32 can extend from the upper shroud plate 132 or from a location at about a juncture of the upper and outer shroud plates 132, 134, respectively. The alarms 48, indicators 52, switches 44, 46, and cord strain relief device 54 extend, in a preferred arrangement, from the outer shroud plate 134. Again, alternately, these devices can be formed in the upper shroud plate 132 or at about a juncture of the upper and outer shroud plates 132, 134, respectively.

Those skilled in the art will recognize that the present mounting shroud 30, 130 provides a number of advantages over known mounting devices. First, the present mounting shroud 30, 130 provides ready access to the pump 10 to perform maintenance on the pump 10, or to remove the pump 10 from the sump S. The mounting elements 32 provide an arrangement that permits readily connecting and disconnecting the pump 10 from the sump S. The handle 42 formed as part of the mounting element 32*a* eases installation and removal of the pump 10 from the sump S.

In addition, the incorporation of various alarms and switches into the mounting shroud 30, 130 facilitates manufacture of the pump 10. In many known pumps, separate components are incorporated into or subsequently connected to the pump to form the pump assembly. In the present pump shroud 30, 130 arrangement, the previously separate components are mounted within a single, unitary shroud 30, 130 that is mounted to the pump 10.

Those skilled in the art will also recognize that in many known sump pump configurations, it is not uncommon for the pump to shift or tip over within the sump. This can result in the pump float switch binding against the side of the sump or otherwise becoming inoperative. This, in turn, can cause failure of the pump to start and can result in overflow of the sump.

The present mounting shroud 30, 130 provides an easy and effective mounting configuration that prevents the pump 10 from shifting or tipping to the extent that the float switch 44 would bind against the side of the sump S. While this configuration increases the reliability of pump 10 operation, it also permits the pump 10 to be mounted such that a small amount of movement of the assembly is permitted, which reduces the stresses on the components and outer connecting piping that such components and piping would otherwise be subject to, in a rigid or fixed mounting arrangement.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

We claim:

1. A mounting and handling shroud for a pedestal-type sump pump, the sump pump including a base portion housing a pump impeller and a motor having a housing having upper and lower end walls and an outer wall, the motor being operably connected, in spaced relation, to the pump impeller by a shaft, the shroud comprising:

a cup-shaped member having an end shroud plate contiguous with an outer shroud plate extending in a generally perpendicular orientation thereto, said outer shroud plate defining a generally circular configuration, the cup-shaped member surrounding at least one of the upper and lower end walls and portion of the housing outer wall; and at least one mounting member formed in said cup shaped member, said at least one mounting member defining an opening therein for receiving an associated securing element, said mounting member defining a handle having a first projecting portion extending from said shroud in a direction generally transverse to said outer shroud plate, and a leg portion contiguous with said first projecting portion and extending generally parallel to and spaced from said outer shroud plate.

2. The mounting member in accordance with claim 1 including three mounting elements, wherein at least one of said mounting elements defines said handle.

3. The mounting member in accordance with claim 1 including a pump start switch integral with said shroud.

4. The mounting member in accordance with claim 1 wherein said end shroud plate is an upper shroud plate.

5. The mounting member in accordance with claim 1 wherein said end shroud plate is a lower shroud plate, said lower shroud plate defining an opening therein for receiving the pump shaft.

6. The mounting member in accordance with claim 3 wherein said pump start switch is integral with said outer shroud plate.

7. The mounting member in accordance with claim 1 including at least one of a high level alarm, a power indicator and a pump running indicator.

8. The mounting member in accordance with claim 1 including a power cord strain relief element formed integral with said shroud.

* * * * *